US006302715B1

(12) United States Patent
Sato et al.

(10) Patent No.: US 6,302,715 B1
(45) Date of Patent: Oct. 16, 2001

(54) CARD CONNECTOR OF REDUCED-HEIGHT PROFILE

(75) Inventors: Takeshi Sato; Kinzo Narumo; Yuji Hirai, all of Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/233,166

(22) Filed: Jan. 19, 1999

(30) Foreign Application Priority Data

Nov. 2, 1998 (JP) ..... 10-311835

(51) Int. Cl.[7] ..... H01R 13/62
(52) U.S. Cl. ..... 439/159
(58) Field of Search ..... 439/159, 160, 439/152

(56) References Cited

U.S. PATENT DOCUMENTS 5,288,247 * 2/1994 Kaufman ..... 439/607
5,443,395 * 8/1995 Wang ..... 439/159
5,707,245 * 1/1998 Yamamoto et al. ..... 439/160
5,795,190 * 8/1998 Ono ..... 439/607
6,000,958 * 12/1999 Ishida et al. ..... 439/159
6,015,309 * 1/2000 Nakamura et al. ..... 439/159
6,071,133 * 6/2000 Ho et al. ..... 439/159
6,106,313 * 8/2000 Chen ..... 439/159

* cited by examiner

*Primary Examiner*—Brian Sircus
*Assistant Examiner*—Son V. Nguyen
(74) *Attorney, Agent, or Firm*—Arent Fox Kintner Plotkin & Kahn, PLLC

(57) ABSTRACT

Disclosed is an improved card connector comprising a casing for accommodating a card, a rotary lever pivoted in the casing, and an ejection lever slidably attached to one side of the casing. The ejection lever is so operatively connected to the rotary lever that the inserting of the card in the casing may drive the ejection lever toward the front side of the casing through the agency of the turning rotary lever, and that the pushing of the ejection lever toward the rear side of the casing may eject the card out of the front side of the casing through the agency of the turning rotary lever. The rotary lever is pivotally mounted to the ceiling of the casing by a tongue-like piece extending across the rotary lever from one lateral side of a window opening of the ceiling plate. The window opening is made by cutting a selected area of the ceiling plate, and is somewhat wider than the rotary lever, and the tongue-like piece is depressed the thickness of the ceiling plate. The rotary lever has a depression at its pivotal area, the amount of depression corresponding to the thickness of the casing plate. Combination of the depressed tongue and the reentrant section of the rotary lever provides a fulcrum for the rotary lever.

3 Claims, 5 Drawing Sheets

CARD CONNECTOR OF REDUCED-HEIGHT PROFILE

BACKGROUND OF THE INVENTION

1. Field of the Invention

The present invention relates to a card connector for memory cards, PC cards, compact flash cards or cards which may be used in notebook-sized personal computers or portable terminal devices.

2. Description of Related Art

As shown in FIG. 7, a conventional card connector comprises a rectangular casing 2 of synthetic resin for holding two cards at upper and lower stages, two rotary levers 3 pivoted with a pin 8 to the rear side of the casing 2, two ejection levers 4 slidably attached to one side of the casing 2 with their rear ends loosely connected to one ends of the rotary levers 3, and with their front ends press-fitted in first buttons 5 of synthetic resin, which are pivoted to second buttons 6 of synthetic resin to permit the second buttons 6 to turn 90 degrees relative to the first buttons 5.

A card 1 is inserted in a selected compartment of the casing 2. As the rotary lever 3 is pushed by the card 1, the rotary lever 3 is made to turn about the pin 8, so that the ejection lever 4 is moved in the direction opposite to the direction in which the card 1 is inserted.

The casing 2 of synthetic resin has metal springs attached to its inside for grounding purpose.

Referring to FIG. 8, the rotary lever 3 is pivoted to the rear end of the casing 2 by using a headed bolt 8. Specifically the headed bolt 8 is press-fitted in a bore 2*b* made in the frame 2*a*, which is placed on the rear side of the casing 2 for holding a plurality of contacts 9. A shield plate 7 is sandwiched between the rotary lever 3 and the frame 2*a*. Thus, the thickness "a" from the upper surface of the frame 2*a* to the upper surface of the head of the headed bolt 8 is about 1 millimeter, and the total thickness including the one millimeter-thick frame 2*a* is 2 or more millimeters.

The relatively large thickness is a significant hindrance to the down-sizing of the card connector. Also, disadvantageously the casing of synthetic resin requires the attaching of spring pieces for grounding purposes. This increases the number of parts to be assembled, and accordingly the assembling and manufacturing cost.

SUMMARY OF THE INVENTION

One object of the present invention is to provide a card connector of a reduced-height profile which is free of defects as described above.

To attain this object a card connector comprising a casing for accommodating a card, a rotary lever pivoted in the casing, and being responsive to insertion of the card for rotating in the casing, and an ejection lever slidably attached to one side of the casing, and being so operatively connected to the rotary lever that the inserting of the card in the casing may drive the ejection lever toward the front side of the casing through the agency of the turning rotary lever, and that the pushing of the ejection lever toward the rear side of the casing may eject the card out of the front side of the casing through the agency of the turning rotary lever, is improved according to the present invention in that the rotary lever is pivotally mounted to the ceiling of the casing by a tongue-like piece extending across the rotary lever from one lateral side of a window opening of the ceiling plate, which window opening is made by cutting a selected area of the ceiling plate, and is somewhat wider than the rotary lever, the tongue-like piece being depressed the thickness of the ceiling plate. The rotary lever may have a depression at its pivotal area, the amount of depression corresponding to the thickness of the casing plate.

The fulcrum of the rotary lever thus provided is two-plate thick, thereby permitting the card connector to be reduced significantly in height.

The casing may be of metal, and may have cantilever-like resilient projections integrally connected to the inside of the casing for pushing the card to reduce plays which otherwise, would appear between the casing and the card for rattling.

With this arrangement, the card is pushed against the ceiling of the casing, leaving a significant space between the card and the underlying printed circuit board to prevent the printed circuit board from being rubbed by the card when it is repeatedly inserted in the card connector.

Other objects and advantages of the present invention will be understood from the following description of a card connector according to one embodiment of the present invention, which is shown in accompanying drawings.

BRIEF DESCRIPTION OF THE DRAWINGS

FIG. 3(A) is a sectional view taken along the line B—B in FIG. 1 whereas

DESCRIPTION OF THE PREFERRED EMBODIMENTS

Figure 1:
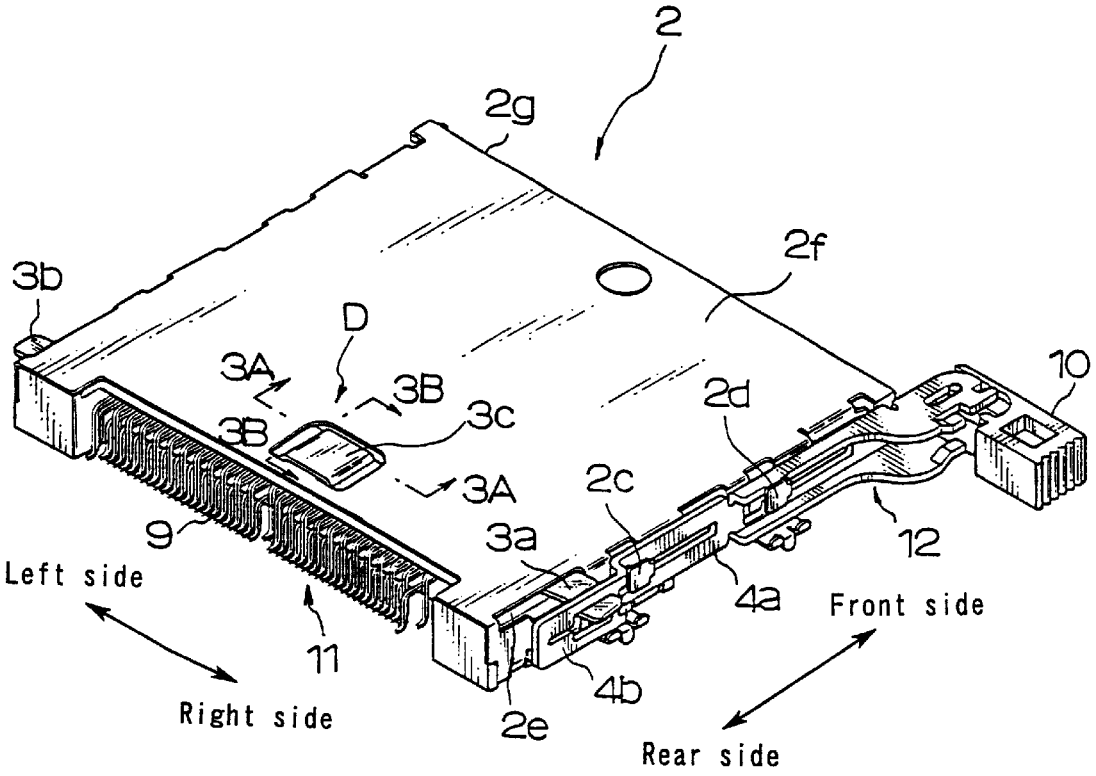
FIG. 1 is a perspective view of a card connector according to the present invention.

FIGS. 1 to 6 show a card connector according to the present invention. In these drawings same parts as used in the conventional card connector are indicated by the same reference numerals as used in FIGS. 7 and 8. As shown in FIG. 1, the card connector 11 comprises a casing or shell 2 of metal such as stainless steel for accommodating a card. The shell 2 has engagement projections 2*c* and 2*d* cut and raised from its opposite longitudinal sides; the engagement projections 2*c* and 2*d* on one or the other longitudinal side can be selected and used for fixing a card ejection device, depending on which longitudinal side is convenient for the attaching of the card ejection device in a particular portable device to which the card connector is to be fixed. A metal ejection lever 4*a* has an ejection button 10 pivoted to its end, and the ejection lever 4*a* is slidably attached to the selected longitudinal side by means of the engagement projections 2*c* and 2*d*.

The shell 2 has a rotary lever 3 pivoted therein, allowing its rear end 3*a* to appear from the slit 2*e* of the longitudinal side of the shell 2, and the rear end 3*a* of the rotary lever 3 is loosely connected to the rear end 4*b* of the ejection lever

4*a*. The rotary lever 3 is responsive to insertion of the card for rotating in the shell 2, thereby driving the ejection lever 4*a* toward the front side of the shell 2. To the contrary, the pushing of the ejection lever 4*a* toward the rear side of the shell 2 ejects the card out of the front side of the shell.

Figure 2:
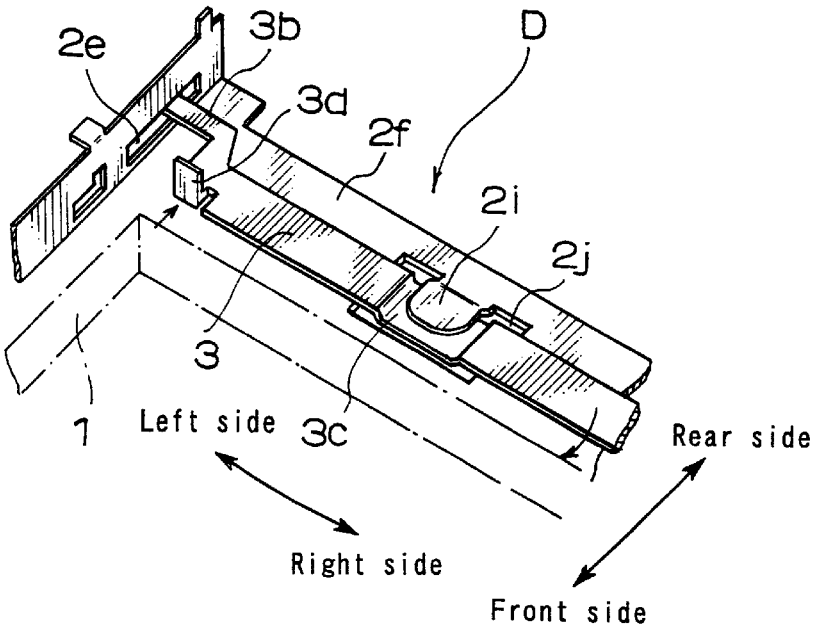
FIG. 2 is an enlarged perspective view of the rotary lever of the card ejection device.
Figure 3A:
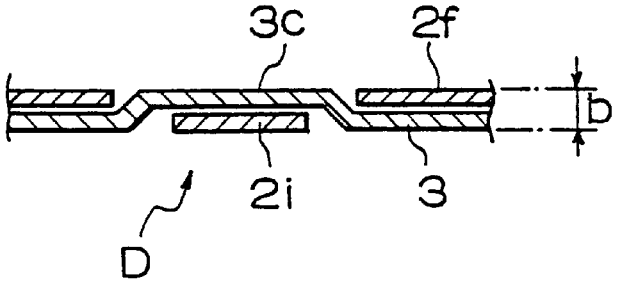
Figure 3B:
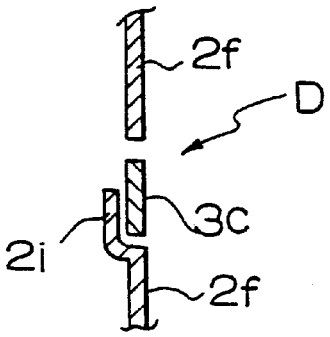
FIG. 3(B) is a sectional view taken along the line C—C in FIG. 1.

Referring to FIGS. 2 and 3, the rotary lever 3 is a rectangular piece having a reentrant section 3*c* at its intermediate area, and is pivotally mounted to the ceiling of the shell 2 as described below. A window opening 2*j*, which has a cantilever-like tongue 2*i* extending inward from one lateral side, is made by cutting a selected area of the ceiling plate. The window opening 2*j* is somewhat wider than the width of the rotary lever 3. As shown, the tongue 2*i* is depressed the thickness of the ceiling plate (see FIG. 3A) to extend toward the card inlet 2*g* (see FIG. 1). The reentrant section 3*c* of the rotary lever 3 is fitted in the window opening 2*j* while allowing the tongue 2*i* to traverse the reentrant section 3*c* of the rotary lever 3. The step-down, ceiling-to-tongue transition plays a role of fulcrum for the rotary lever 3.

The tongue 2*i* can hold the rotary lever 3, not allowing the rotary lever 3 to fall off from the window opening 2*j*; the reentrant section 3*c* of the rotary lever 3 is caught by the counter lateral edge of the window opening 2*j* when the rotary lever 3 is displaced longitudinally.

Figure 8:
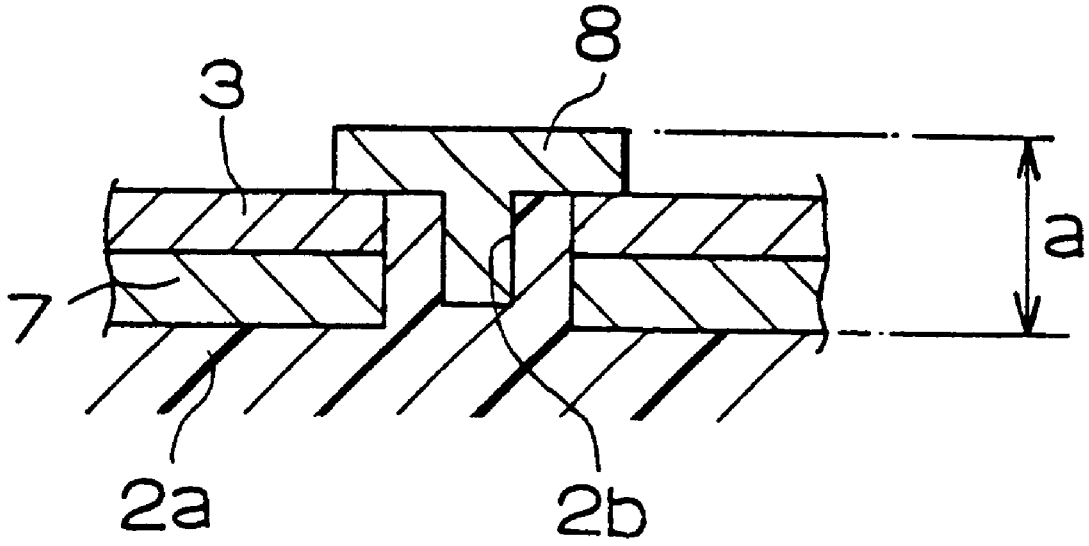
FIG. 8 is a sectional view of the card connector taken along the line A—A in FIG. 7.

Referring to FIG. 3, the combination of the depressed tongue 2*i* and the reentrant section 3*c* of the rotary lever 3 provides a fulcrum D of minimum thickness "b", that is, the thickness of the ceiling plate 2*f* (about 0.3 millimeters) plus the thickness of the reentrant section 3*c* (about 0.3 millimeters), much thinner than the thickness of the fulcrum of the rotary lever in the conventional card connector (see FIG. 8). Accordingly the profile of the card connector according to the present invention can be reduced to possible minimum.

As shown in FIG. 2, the rotary lever 3 has a riser 3*d* formed on its end. When the card 1 is inserted in the shell 2, the end of the card 1 abuts on the riser 3*d* to push it backward, as shown in phantom lines. To the contrary when the rotary lever 3 is rotated, the card 1 is pushed forward by the riser 3*d*, thereby ejecting the card 1 from the card inlet 2*g* of the shell 2.

Figure 4:
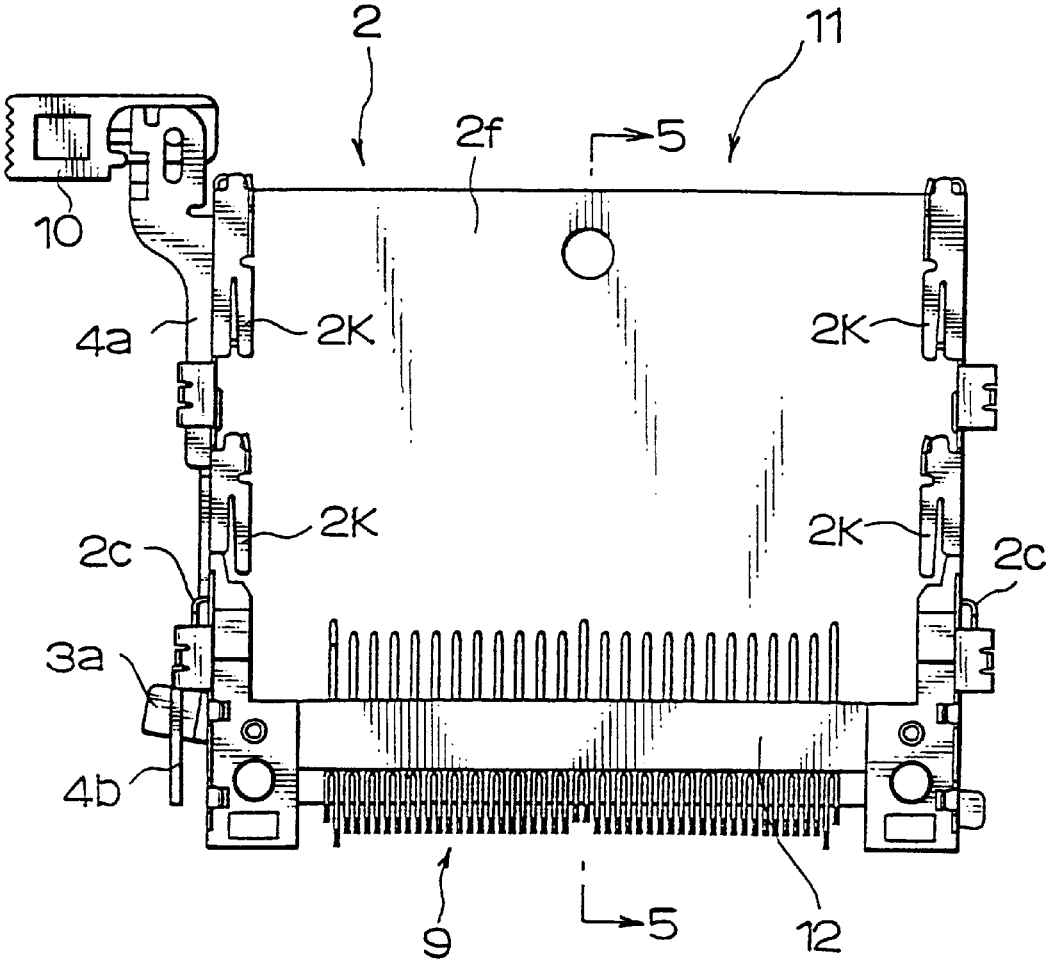
FIG. 4 is a bottom view of the card connector.
Figure 5:
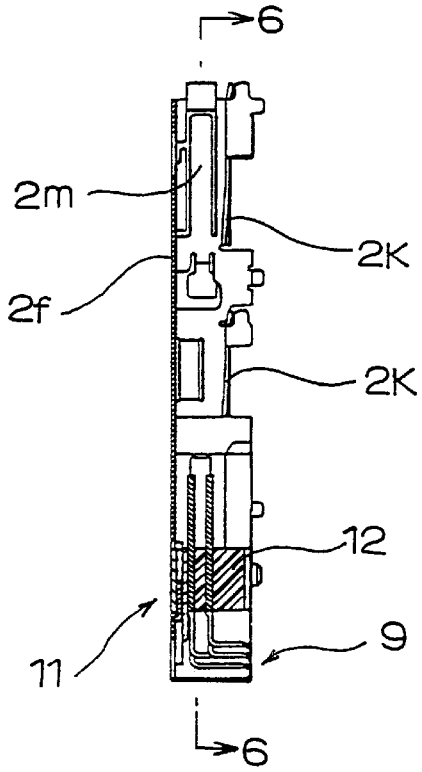
FIG. 5 is a sectional view of the card connector taken along the line E—E in FIG. 4.

Referring to FIGS. 4 and 5, the shell 2 has four cantilever-like push springs 2K formed on its opposite longitudinal sides for pushing a card 1 against the ceiling 2*f*. The shell 2 has an insulating contact mount 12 of synthetic resin fixed to its rear lateral edge. The contact mount 12 has a plurality of contacts 9 arranged at regular intervals and mounted therein.

The card 1 can be pushed against the ceiling 2*f* with the push springs 2K, thereby preventing the rattling of the card 1 in the shell 2. When the card connector 11 is fixed to the printed circuit board in a portable electronic device, the card 1 is assured to be laid apart from the underlying printed circuit board, thereby preventing the card 1 from rubbing against the printed circuit board when the card 1 is repeatedly inserted in the card connector 11.

Figure 6:
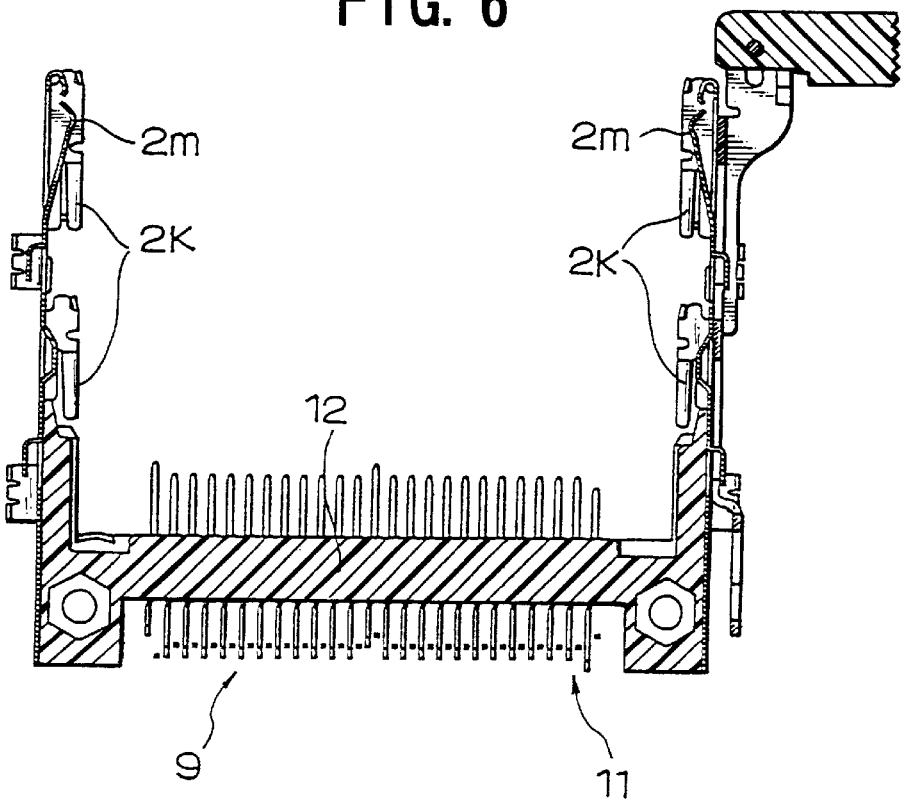
FIG. 6 is a sectional view of the card connector taken along the line F—F in FIG. 5.
Figure 7A:
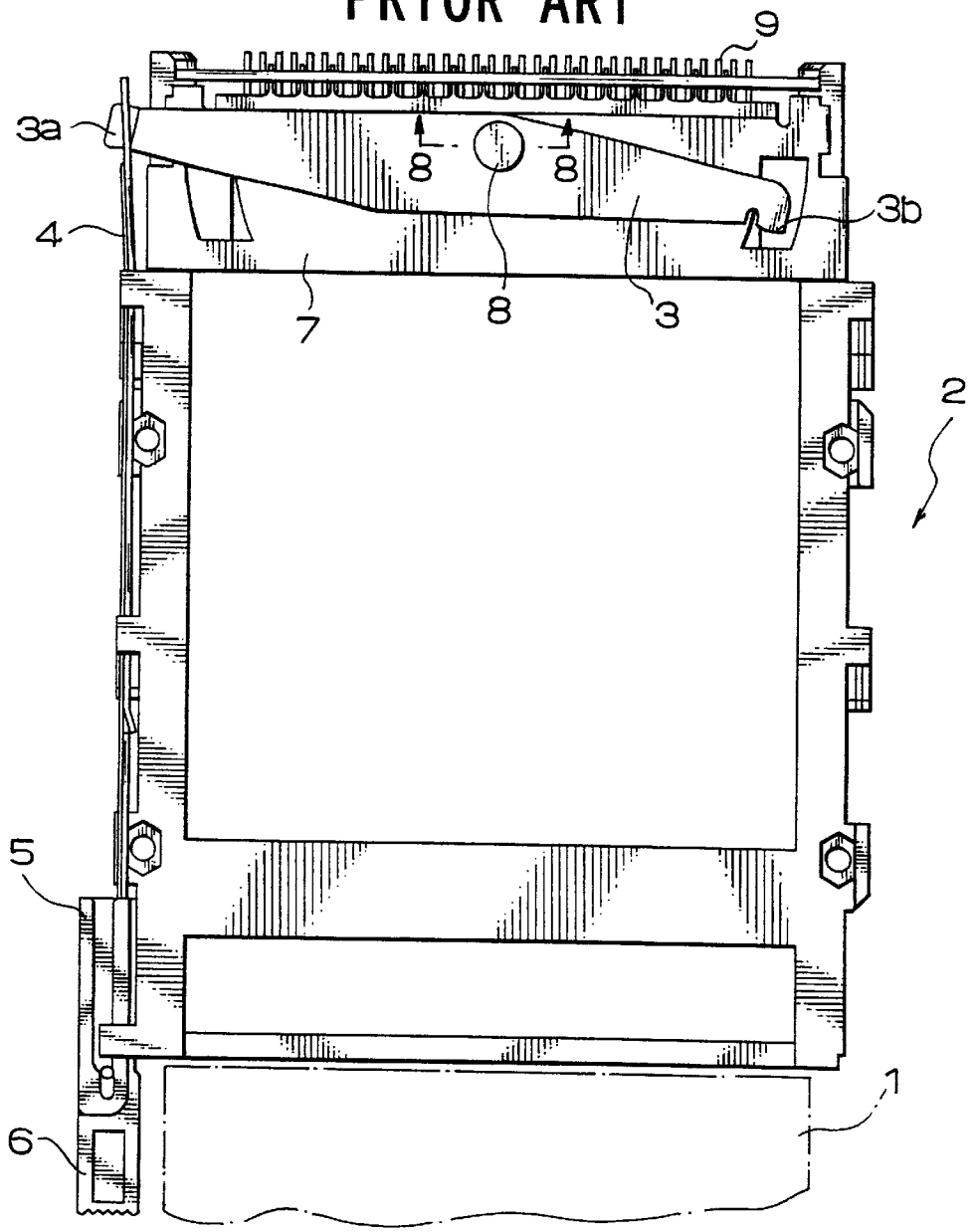
FIG. 7A PRIOR ART
FIG. 7A is a plane view of a conventional card connector.
Figure 7B:
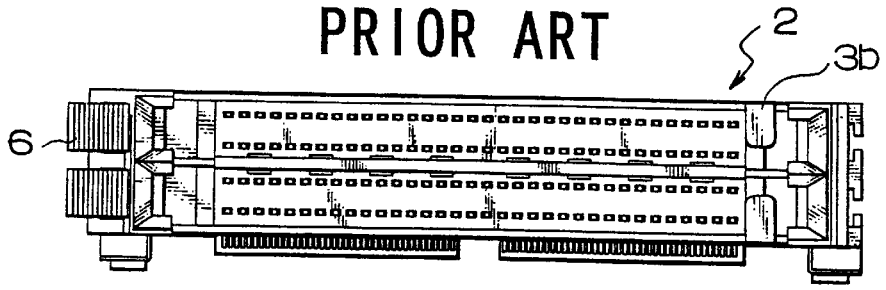
FIG. 7B PRIOR ART
FIG. 7B is a rear view of the conventional card connector.

Referring to FIG. 6, the shell 2 has two cantilever-like springs 2*m* fixed to its opposite longitudinal sides, close to the card inlet 2*g*, which cantilever-like springs 2*m* are adapted to be put in contact with the grounding pieces of the card 1, thereby grounding the card 1.

As may be understood from the above, thanks to the combination of the depressed tongue 2*i* and the reentrant section 3*c* of the rotary lever 3 the profile of the card connector 11 can be reduced to possible minimum height, thus meeting the demand for reducing the thickness of the portable terminal device.

The step-down, ceiling-to-tongue transition functions as the fulcrum D for the laterally elongated rotary lever 3, permitting the fulcrum point to be shifted to the best or most effective position as the rotary lever 3 turns.

The card 1 is pushed against the ceiling 2*f* of the shell 2 by the push springs 2K, thus leaving a significant gap between the card 1 and the underlying printed circuit board to prevent the rubbing of the card against the underlying printed circuit board.

The shell 2 is made of metal, and the ceiling plate 2*f* has its opposite longitudinal sides bent inward to form the engagement projections 2*c*, 2*d* and the push springs 2K. Thus, the shell 2 has a good strength, and the number of parts to be assembled can be reduced, and accordingly the number of the assembling steps and hence the manufacturing cost can be reduced.

What is claimed is:

1. A card connector comprising:

a casing for accommodating a card, a rotary lever pivotally retained at a rear side of the casing and being responsive to an insertion of the card, and an ejection lever slidably attached to one side of the casing, and slidably connected to the rotary lever such that inserting the card into the casing turns the rotary lever that drives the ejection lever toward a front side of the casing, and that pushing the ejection lever toward the rear side of the casing turns the rotary lever to eject the card out of the front side of the casing, wherein the casing has a ceiling plate with a thickness, said ceiling plate defining an interior upper surface of said casing, said casing also having at the rear side a tongue piece and an aperture, the tongue piece having a depression to a depth equal to the thickness of the ceiling plate and extending across the aperture therein from one lateral side of the aperture, the rotary lever being disposed across the aperture, said aperture having a width wider than a width of the rotary lever, the rotary lever being pivotally mounted to the ceiling plate by the tongue piece.

2. The card connector according to claim 1, wherein the rotary lever has a depression having a depth substantially equal to the thickness of the ceiling plate, the depression in the rotary lever being operatively connected to the depression in the tongue piece.

3. The card connector according to claim 1, wherein the casing is metal, and has cantilever resilient projections integrally connected to an inside of the casing for pushing the card to reduce rattling between the casing and the card.

* * * * *